US008502734B2

(12) United States Patent
Motta Cruz et al.

(10) Patent No.: US 8,502,734 B2
(45) Date of Patent: Aug. 6, 2013

(54) PRINTED ANTENNA HAVING A DUAL-BEAM DIAGRAM

(75) Inventors: Eduardo Motta Cruz, Saint Herblain (FR); Jean Philippe Dessarce, Palinges (FR); Mohamed Himdi, Rennes (FR); Franck Colombel, Montfort sur Meu (FR)

(73) Assignee: Bouygues Telecom, Boulogne Billancourt (FR)

( * ) Notice: Subject to any disclaimer, the term of this patent is extended or adjusted under 35 U.S.C. 154(b) by 787 days.

(21) Appl. No.: 12/362,335

(22) Filed: Jan. 29, 2009

(65) Prior Publication Data

US 2009/0224980 A1 Sep. 10, 2009

(30) Foreign Application Priority Data

Jan. 30, 2008 (FR) ..... 08 50581

(51) Int. Cl.
*H01Q 1/38* (2006.01)

(52) U.S. Cl.
USPC ..... 343/700 MS; 343/749

(58) Field of Classification Search
USPC ..... 343/700 MS
See application file for complete search history.

(56) References Cited

U.S. PATENT DOCUMENTS 4,887,089 A * 12/1989 Shibata et al. ..... 343/700 MS
5,872,542 A * 2/1999 Simons et al. ..... 343/700 MS
6,118,406 A * 9/2000 Josypenko ..... 343/700 MS
6,252,553 B1 * 6/2001 Solomon ..... 343/700 MS
6,320,542 B1 11/2001 Yamamoto et al.
7,505,002 B2 * 3/2009 Surittikul et al. ..... 343/700 MS
2006/0139212 A1 6/2006 Reuss
2007/0268188 A1 * 11/2007 Guha et al. ..... 343/700 MS

FOREIGN PATENT DOCUMENTS

WO WO 01/86754 A1 11/2001

OTHER PUBLICATIONS

Kraus, John D. Capacitors and Capacitance. Electromagnetics: Second Edition. McGraw Hill, 1973, pp. 49-50.*
Liang, X.-L., Zhong, S.-S. and Wang, W. (2005), Design of a dual-polarized microstrip patch antenna with excellent polarization purity. Microw. Opt. Technol. Lett., 44: 329-331. doi: 10.1002/mop.20625.*

* cited by examiner

*Primary Examiner* — Michael C Wimer
*Assistant Examiner* — Amal Patel
(74) *Attorney, Agent, or Firm* — Blakely Sokoloff Taylor & Zafman

(57) ABSTRACT

The invention relates to a printed antenna comprising a ground plane, a substrate stacked to the ground plane, a metal deposit made on the substrate in order to form therein a resonating patch (3), and a means of supplying to excite the resonating patch, characterized in that the patch has dimensions that are adapted for the patch to be able to radiate in both upper electromagnetic modes $TM_{02}$ and $TM_{20}$, and in that the means of supplying makes it possible to excite the patch on an excitation point (4) arranged along the patch so that the patch resonates in a single of said upper electromagnetic modes, by inducing this way a dual-beam radiation diagram with, in the same plane orthogonal to the patch, two main misaligned and symmetric lobes in relation to the normal to the patch.

8 Claims, 6 Drawing Sheets

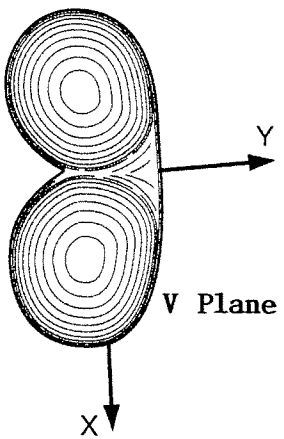
FIG. 12
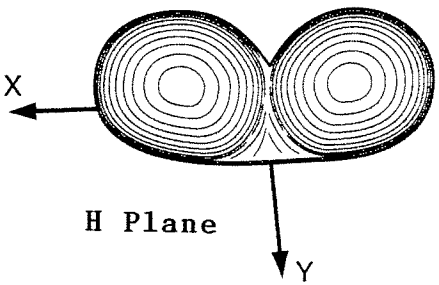
FIG. 11
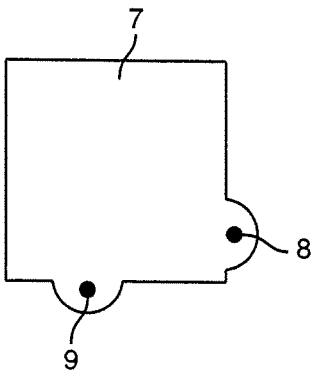

PRINTED ANTENNA HAVING A DUAL-BEAM DIAGRAM

The field of the invention is that of telecommunication antennas, and more particularly that of antennas for mobile communication cellular networks.

The invention relates more precisely to an antenna made with printed technology, of the type comprising a ground plane, a substrate stacked to the ground plane and a metal deposit made on the substrate in order to form therein a resonating patch.

The urban antennas of GSM/DCS/UMTS base stations have in particular the task to absorb the high traffic generated in areas of high affluence: shopping centres, boutiques, pedestrian streets, etc.

These antennas are furthermore subjected to landscape integration constraints.

In the case where the zone to be covered is elongated, in particular a corridor or a pedestrian street, the use of a directive antenna with a maximal gain in the direction perpendicular to the plane of the antenna is not optimal. This type of antenna effectively favours the nearby vicinity of the antenna, especially the building just opposite from the antenna, to the detriment of the zones located at the ends of the corridor or of the street.

The invention aims to overcome this disadvantage, and propose to this effect a printed antenna comprising a ground plane, a substrate stacked to the ground plane, a metal deposit made on the substrate in order to form therein a resonating patch, and a means of supplying to excite the resonating patch, characterised in that the patch has dimensions that are adapted in order for the patch to be able to radiate in both upper electromagnetic modes $TM_{02}$ and $TM_{20}$, and that the means of supplying makes it possible to excite the patch on an excitation point arranged in such a way that the patch resonates in a single of said upper electromagnetic modes, inducing in this way a dual-beam radiation diagram with, in the same plane orthogonal to the patch, two main misaligned lobes that are symmetric in relation to the normal to the patch.

Certain preferred aspects, but non-limiting, of this antenna are as follows:

the patch is square with side equal to $k*\lambda_s$ where k is a strictly positive integer and $\lambda_s$ shows the wavelength in the substrate;

the excitation point is substantially located at ¾ of one of the sides of the patch;

the means of supplying supplies the patch by electromagnetic coupling;

a coupling slot is cut in the ground plane;

the means of supplying supplies the patch by contact;

the means of supplying is a microstrip line;

the means of supplying is a coaxial probe;

the antenna further comprises means of compensation capacitive aiming to weaken the inductive behaviour on the input impedance of the antenna supplied via coaxial probe;

the means of compensation capacitive take the form of an extension of the patch around the excitation point;

the extension has a surface substantially equal to that of a half-disk of radius Re=4*h where h designates the thickness of the substrate;

the extension is a half-disk;

the excitation point is positioned midway between the side of the patch and the edge of the half-disk;

the patch has a first and second excitation points on the orthogonal sides of the patch so that the patch can resonate in a first upper mode in a first plane orthogonal to the patch when it is excited from the first excitation point and in a second upper mode in a second plane orthogonal to the patch and to the first plane when it is excited from the second excitation point, with the means of supplying being configured to alternatively excite the patch from the first and from the second excitation points;

the patch has four excitation points arranged each one on side of the patch, with the means of supplying being configured to excite the patch by sequentially supplying the excitation points, the patch having as such a conical radiation diagram;

the antenna is optically transparent to visible light.

Other aspects, purposes and advantages of this invention shall appear more clearly when reading the following detailed description of forms of preferred embodiments of the latter, provided by way of a non-limiting example, and made in reference to the annexed drawings wherein:

FIG. 11 shows a patch with two excitation points arranged along the patch in accordance with an implementation of the invention;

FIG. 12 shows the alternating obtaining of a dual-beam radiation in the horizontal plane then in the vertical plane with the antenna of FIG. 11;

The invention in particular has for purpose to propose a printed antenna that has a bi-directional radiation diagram in the horizontal plane (elevated view) able to offset the losses induced by the path of the signals from or to the mobile terminals located at the ends of the elongated area to be covered.

Figure 1:
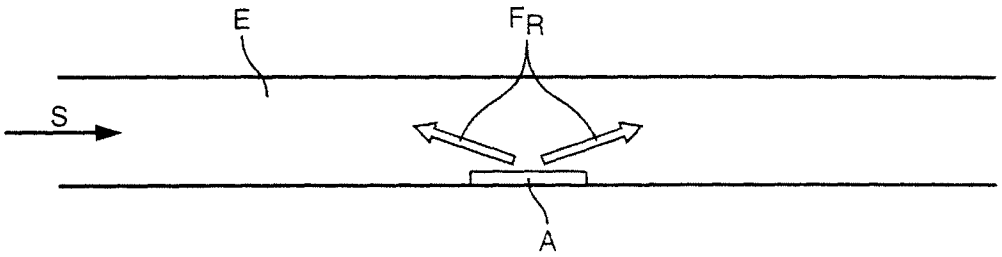
FIG. 1 shows the coverage of a confined space of the pedestrian street type by the antenna according to the invention.

FIG. 1 shows in this respect the coverage of a confined space E in the form of a corridor or pedestrian street that is sought to be obtained, with two favoured directions of radiation (cf. arrows $F_R$) of the antenna A, these favoured directions being misaligned in relation to the main axis of radiation perpendicular to the direction S of the corridor or of the pedestrian street in order to best cover the ends of the space E.

The solution recommended by the invention is an antenna made with printed technology radiating according to a dual-beam radiation diagram from a single resonating patch operating on an upper electromagnetic mode. The patch more precisely carried out by metal deposit on a substrate, this substrate resting on a ground plane.

In this respect, it is provided within the framework of the invention to use a patch having the dimensions adapted so that the patch is able to resonate in both upper modes $TM_{02}$ and $TM_{20}$.

Figure 2:
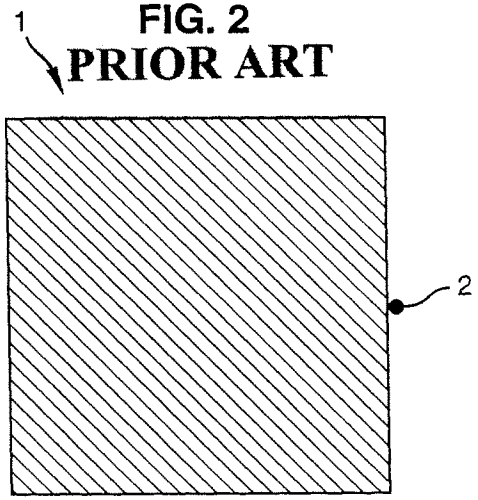
FIG. 2 PRIOR ART
FIGS. 2 to 4 show respectively a square patch excited at the middle of one of its sides, its distribution surface of currents and its radiation diagram.

FIG. 2 shows a square patch 1 having a side with dimensions equal to the wavelength in the substrate $\lambda_s$ (where conventionally the dimensions of a resonating patch are of a magnitude of a half wavelength).

The supply of the patch on an excitation point 2 arranged in the middle of one of the sides of the patch 1 generates the excitation of two modes that are transverse and perpendicular between them, TM02 and TM20.

Figure 3:
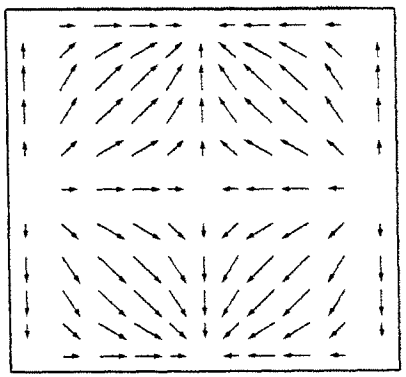
FIG. 3 PRIOR ART
Figure 4:
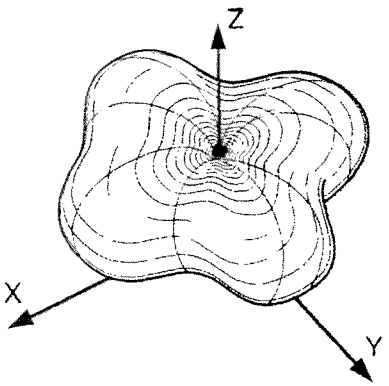
FIG. 4 PRIOR ART

FIG. 3 shows the distribution of the surface currents simulated by CAD software in the patch 1 of FIG. 2, and FIG. 4 shows the radiation diagram simulated in 3D of the patch 1 showing the operation of the two modes radiated by the presence of four main lobes. The theoretical gain raises it to −1 dBi.

The patch 1 radiates as such, from the two sides opposite each other, anti-phase fields, inducing a dual-beam diagram for each plane orthogonal to the plane of the antenna (a dual-beam diagram in the vertical plane, a dual-beam diagram in the horizontal plane), i.e. in the end a quadri-beam radiation diagram.

Such a quadri-beam diagram is however not desirable, in the sense where the two lobes located in the vertical plane of the antenna are not useful. The energy located in these lobes indeed does not provide the desired coverage function, since these lobes are not directed along the length of the corridor or of the street to be covered.

It is proposed within the framework of the invention to suppress one of the upper electromagnetic modes, in order to reduce the behaviour in radiation of the antenna to a single mode and as such produce a dual-beam radiation diagram. To this effect, it is provided within the framework of the invention to move the excitation point along the patch until one of the modes TM02 or TM 20 fades out.

Figure 7:
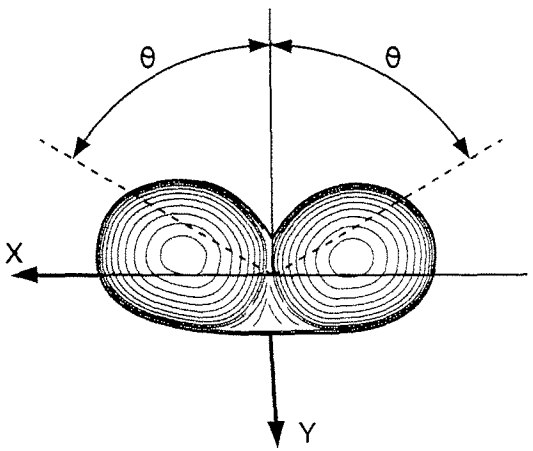
FIGS. 5 to 7 show respectively a patch of an antenna in accordance with a possible embodiment of the invention, its distribution surface of currents and its radiation diagram.
Figure 6:
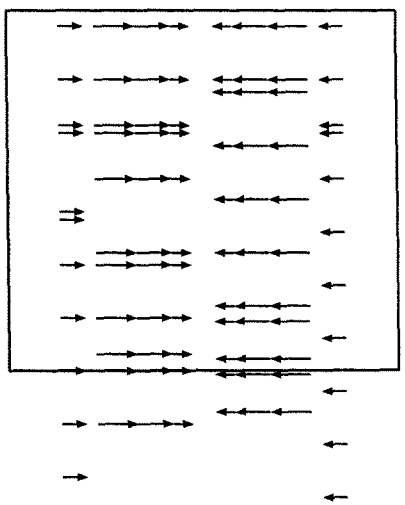

The original positioning of the supply makes it possible for the antenna according to the invention to operate on a single upper mode, with a distribution of surface currents of the type of that shown in FIG. 6 (corresponding to the patch 3 of the diagram of FIG. 5 mentioned hereinafter), inducing a dual-beam radiation diagram of the type of the one shown on the 3D simulation of FIG. 7 with, in a same plane orthogonal to the patch, two lobes that are misaligned and symmetric in relation to the normal to the patch.

According to a possible embodiment of the invention, the patch is square with side substantially equal to $k*\lambda_s$ where k is a strictly positive integer and $\lambda_s$ shows the wavelength in the substrate.

Figure 5:
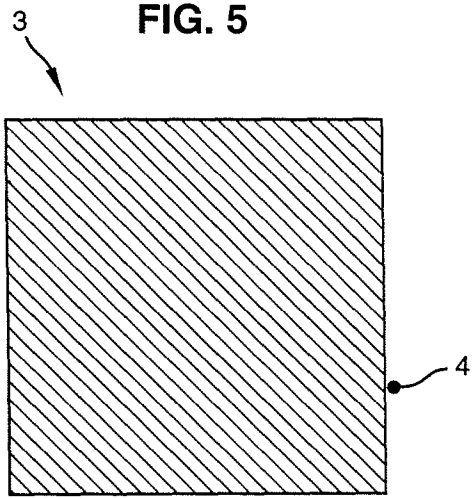

This concerns for example a square patch 3 of side $\lambda_s$, such as shown in FIG. 5.

Within the framework of this embodiment, the means of supplying come to excite the patch on an excitation point 4 arranged at ¾ of one of the sides of the patch.

The excitation at ¾ of one of the sides of the patch makes it possible to inhibit the radiation of the undesired transverse mode (for example the mode $TM_{20}$), since it imposes the arrival of a maximal current whereas the field should cancel out in order to allow for the radiation of said mode.

Note that the excitation at ¾ of the side is indifferent on the left or right side of the patch.

Note that the patch 3 of FIG. 5 has a theoretical gain of 2 dBi, an increase of 3 dB in relation to the patch 1 of FIG. 2, due to the focalising of the energy on two lobes instead of four.

These dual-beam diagram of an antenna in accordance with the invention has, in the same plane orthogonal to the patch, two main misaligned and symmetric lobes in relation to the normal to the patch. The difference of the main axes of radiation in relation to the normal to the patch (shown by θ in FIG. 7) depends in particular on the dielectric constant of the substrate, according to $$\theta=\arcsin(\lambda o/2d)=\arcsin(\sqrt{\in e}/2)$$

With:

∈e: effective dielectric constant of the substrate

λo: wavelength in the vacuum

λs: wavelength in the substrate, $\lambda s=\lambda o/\sqrt{\in e}$

By way of example, for a substrate of the Plexiglas (PPMA) type, used in a prototype developed by the inventors, ∈e=2.7. An inclination angle of both lobes of θ=55° is then obtained.

According to a possible embodiment of the invention, the means of supplying supplies the patch by electromagnetic coupling. This coupling is for example carried out by the intermediary of a slot made in the ground plane across from the aforementioned excitation point.

According to another possible embodiment of the invention, the means of supplying supplies the patch via contact.

The means of supplying is for example a microstrip line coming into contact with the patch on the aforementioned excitation point. It can also be a coaxial probe.

Figure 8:
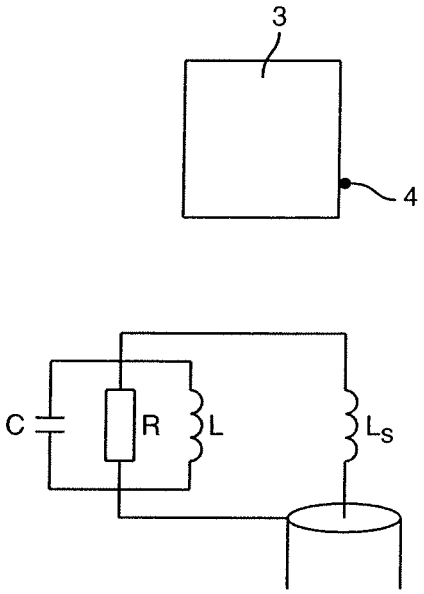
FIG. 8 is a diagram showing the inductive behaviour of a supply of the antenna via a coaxial probe.

The input impedance of the antenna supplied by coaxial probe can have a non-negligible inductive behaviour. This behaviour is represented by an inductance $L_s$ in series with the antenna (represented by a resonant circuit RLC) on the diagram of FIG. 8.

According to an advantageous alternative of the invention, the antenna further comprises means of compensation capacitive aiming to weaken the inductive behaviour of the input impedance of the antenna supplied by coaxial probe.

The means of compensation capacitive (represented by a capacitance $C_e$ in FIG. 9) makes it possible to offset the effect of the inductance $L_s$ and consequently to adapt the input impedance of the antenna.

Figure 9:
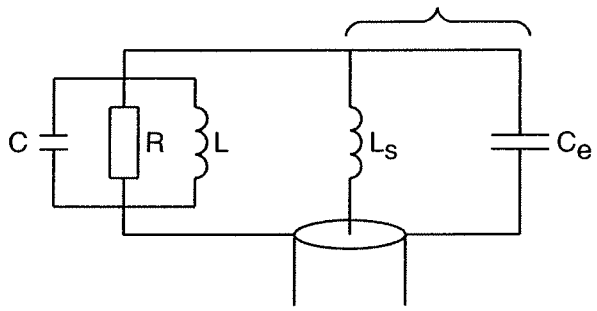
FIG. 9 is a diagram showing the implementation of a compensation capacitive to the inductive behaviour of the supply of the antenna via a coaxial probe.

As shown in FIG. 9, the means of compensation capacitive can be a part of the body of the antenna by taking for example the form of an extension 5 of the patch of the half-disk type around the excitation point 4.

The radius $R_e$ of the half-disk of the extension 5 is substantially dependent on the wavelength of the coaxial probe crossing the antenna and consequently on the thickness of the substrate. Note that approximately $R_e=4*h$ where h designates the thickness of the substrate.

Figure 10:
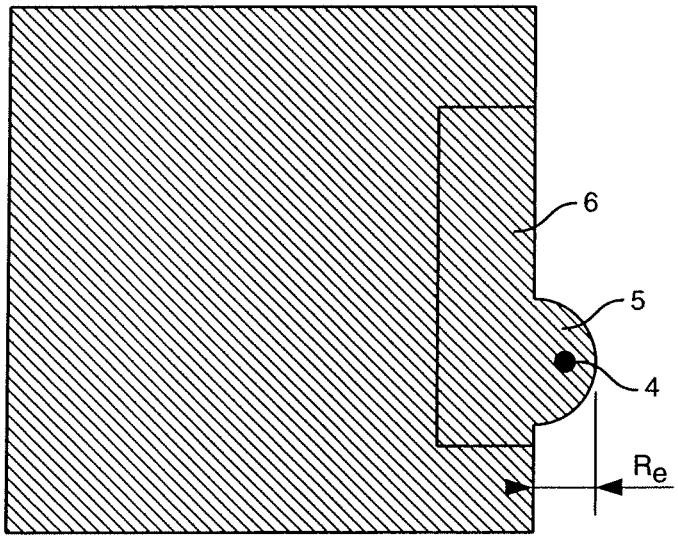
FIG. 10 shows a possible embodiment of the compensation capacitive.

In order to take full advantage of the capacitive effect of the extension, the position of the coaxial probe can be positioned midway between the side of the patch and the edge of the half-disk as is shown in FIG. 10.

The capacitive extension is not limited to an extension as half-disk, but can take other geometric forms. Note that the total surface of the extension must be approximately equal to that of the half-disk in order to produce a similar capacitive effect.

In what precedes, the antenna according to the invention had a single excitation point for the supply of the patch and the generation of a dual-beam diagram in the same plane.

The invention is not however limited to this particular case, but also extends to alternatives wherein the antenna has a plurality of excitation points arranged along the patch for each to generate a dual-beam diagram in the same plane.

In the alternative shown by the diagram in FIG. 11, the square patch 7 comprises a first and second excitation points

8, 9 arranged on the orthogonal sides of the patch so that the patch resonates in a first of upper modes (for example TM20) in a first plane orthogonal to the patch when it is excited from the first excitation point and in a second of the upper modes (TM02 in the example) in a second plane orthogonal to the patch and to the first plane when it is excited from the second excitation point. As shown in FIG. 12, the excitation of the patch 7 on point 8 effectively makes it possible to induce a dual-beam radiation diagram in the horizontal plane (plane H), while the excitation of the patch on point 9 makes it possible to induce a dual-beam radiation diagram in the vertical plane (plane V). Within the framework of this alternative, the means of supplying can be configured to alternatively excite the patch from the first and from the second of the excitation points, in such a way that the antenna alternatively presents a dual-beam diagram in the plane H (horizontal diagram) and a diagram (called vertical diagram) orthogonal to the horizontal diagram.

This alternative in particular has application in the design of a compact antenna for the detection of movement and of speed via the Doppler effect in a Janus configuration with two axes (whereas the current applications are configured according to a single axis).

Figure 13:
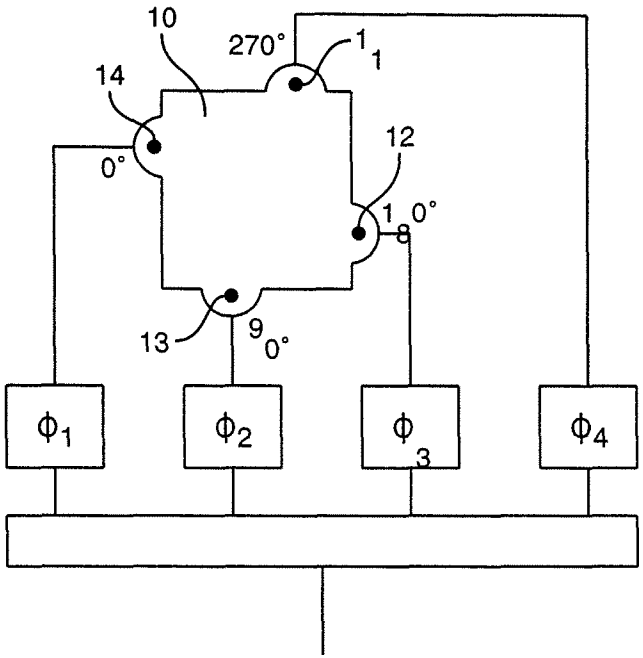
FIG. 13 shows a patch with four excitation points arranged along the patch in accordance with an implementation of the invention.

According to another alternative embodiment shown by the diagram in FIG. 13, the square patch 10 comprises four excitation points 11-14 arranged each on a side of the patch in accordance with the invention (here at the ¾ of each side for a square patch), with the means of supplying being configured to excite the patch by sequentially supplying the excitation points, in such a way that the patch has a conical radiation diagram.

As shown in FIG. 13, the supply of each excitation point 11-14 is delayed by a phase de 90° in relation to the preceding point. Such an alternative makes it possible to obtain a conical configuration with a left or right circular polarised wave according to the direction of sequential supply.

Figure 14:
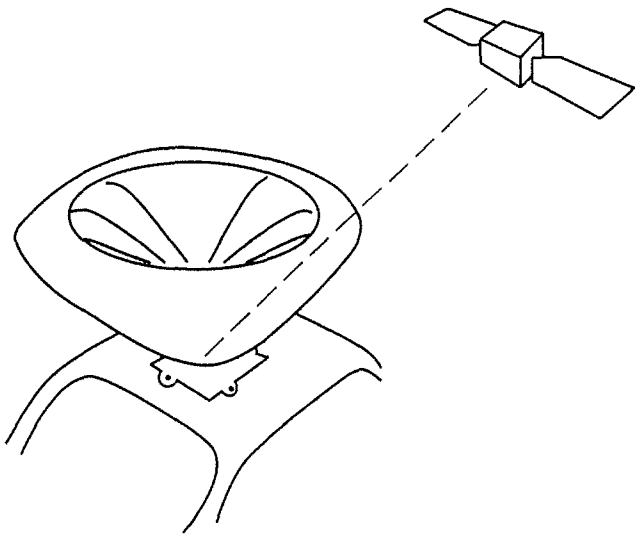
FIG. 14 shows the obtaining of a conical radiation diagram by sequentially supplying the excitation points of the patch of FIG. 13.

This alternative has in particular application in the design of a very compact antenna for on-board satellite reception, in particular on the roof of a car such as is shown in FIG. 14 for the reception of signals coming from geostationary earth-orbiting satellites. Indeed, a geostationary earth-orbiting satellite is located at an angle in relation to the ground of 35° (average for Europe). However, the fact of having an angle $\theta=55°$ in relation to the vertical (case with a plexiglas substrate) makes it possible for the antenna to constitute a solution that is particularly interesting for satellite reception using a horizontal surface (such as the roof of a car).

As mentioned in the introduction, urban antennas are also subjected to landscape integration constraints. In order to satisfy these constraints, the invention provide according to a favoured embodiment an optically transparent antenna with dual-beam diagram.

To this effect, the substrate of the antenna can be of glass, or formed of any other optically transparent dielectric material, for example plexiglas.

Note here that "optically transparent" material refers to a material that is substantially transparent to visible light, allowing at least about 30% of this light to pass through, and more preferably more than 60% of the light.

The ground plane and the resonating patch preferentially of side λs are each formed by deposit of an optically transparent conductive material on a plastic film, for example on a polyester film. The optically transparent conductive material can also be directly deposited by methods of etching. The optically transparent conductive material is more preferably, without this however constituting a limitation, of indium-tin oxide (ITO) or of silver-doped tin oxide (AgHT).

Moreover, the ground plane and the resonating patch can be sandwiched between the optically transparent dielectric layers, such as layers of glass.

Figure 16:
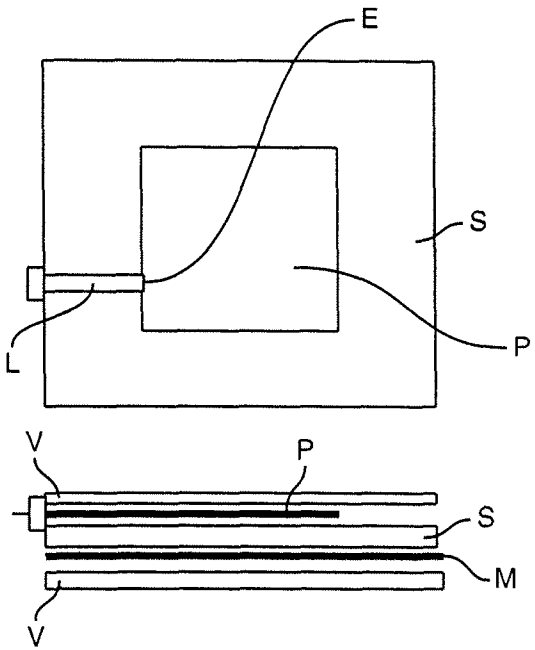
FIGS. 15 and 16 are examples of optically transparent antennas in accordance with the invention.
Figure 15:
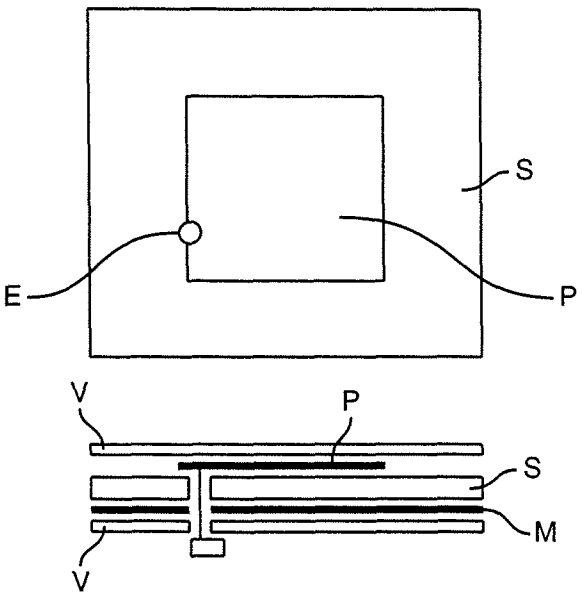

FIGS. 15 and 16 are diagrams of optically transparent antennas provided for the purposes of information.

FIG. 15 shows an optically transparent antenna in accordance with the invention comprising a ground plane M, a substrate S and a resonating patch P, wherein the patch is supplied on an excitation point E arranged in accordance with the invention and supplied by a coaxial probe.

FIG. 16 shows another optically transparent antenna in accordance with the invention comprising a ground plane M, a substrate S and a resonating patch P, wherein the patch P is supplied on an excitation point E via the intermediary of a microstrip line L also made.

In these two FIGS. 15 and 16, the ground plane M and the patch P are sandwiched between two optically transparent layers V.

The invention claimed is:

1. Printed antenna for mobile communication cellular networks comprising a ground plane (P), a substrate (S) stacked to the ground plane, a metal deposit made on the substrate in order to form therein a resonating patch (3, 6, 7, 10, P), and a coaxial probe configured to excite the resonating patch, wherein the patch is a square patch having sides with dimensions substantially equal to $k*\lambda_S$ where k is a strictly positive integer and $\lambda_s$ is the guided wavelength in the substrate, thereby being able to radiate in both upper electromagnetic modes $TM_{02}$ and $TM_{20}$, and wherein the coaxial probe is configured to excite the patch on an excitation point (4, 8, 9, 1 1-15, E) arranged on one side of the patch at substantially $¾*k*\lambda_s$ from one of the vertices of the square patch so that the patch resonates dominantly in a single one of said upper electromagnetic modes, by inducing in this way a dual-beam radiation pattern with, in a same plane orthogonal to the patch, two main misaligned lobes that are symmetric in relation to the normal to the patch, said antenna further comprising means of capacitive compensation (5) in order to reduce an inductance of an input impedance of said antenna supplied by the coaxial probe, said means of capacitive compensation (5) taking the form of an extension of the patch around the excitation point, said extension having a surface substantially equal to that of a half-disk of radius Re=4*h where h designates the thickness of the substrate.

2. Antenna according to claim 1, wherein the coaxial probe is configured to supply the patch via coupling.

3. Antenna set forth in claim 2, wherein a coupling slot is cut in the ground plane.

4. Antenna according to claim 1, wherein the coaxial probe is configured to supply the patch by contact.

5. Antenna set forth in claim 1, wherein the excitation point (4) is positioned midway between the side of the patch (6) and the side of the half-disk (5).

6. Antenna according to claim 1, wherein the patch (7) has a first (8) and second (9) excitation points on orthogonal sides of the patch so that the patch can resonate dominantly in a first upper mode in a first plane orthogonal to the patch when it is excited from the first excitation point and dominantly in a second upper mode in a second plane orthogonal to the patch and to the first plane when it is excited from the second excitation point, the coaxial probe is configured to alternatively excite the patch from the first and from the second excitation points.

7. Antenna according to claim 1, wherein the patch (10) has four excitation points (11-15) arranged each on one side of the patch, the coaxial probe is configured to excite the patch by sequentially supplying the excitation points, the patch having as such a conical radiation diagram.

8. Antenna according to claim 1, wherein said antenna is optically transparent to visible light.

* * * * *